US010087031B2

(12) United States Patent
Otsuka et al.

(10) Patent No.: US 10,087,031 B2
(45) Date of Patent: Oct. 2, 2018

(54) PAPER EJECTION TRAY ASSEMBLY WITH RIBS

(71) Applicant: PFU LIMITED, Kahoku-shi, Ishikawa (JP)

(72) Inventors: Shota Otsuka, Kahoku (JP); Hideaki Shibata, Kahoku (JP)

(73) Assignee: PFU LIMITED, Ishikawa (JP)

( * ) Notice: Subject to any disclaimer, the term of this patent is extended or adjusted under 35 U.S.C. 154(b) by 0 days.

(21) Appl. No.: 15/174,878

(22) Filed: Jun. 6, 2016

(65) Prior Publication Data

US 2017/0121145 A1 May 4, 2017

(30) Foreign Application Priority Data

Nov. 2, 2015 (JP) ..... 2015-216143

(51) Int. Cl.
*B65H 31/20* (2006.01)
*B65H 29/70* (2006.01)
(Continued)

(52) U.S. Cl.
CPC ..... *B65H 31/20* (2013.01); *B65H 29/70* (2013.01); *B65H 31/02* (2013.01); *B65H 31/26* (2013.01);
(Continued)

(58) Field of Classification Search
CPC ..... B65H 29/22; B65H 29/52; B65H 29/70; B65H 31/00; B65H 31/20;
(Continued)

(56) References Cited

U.S. PATENT DOCUMENTS 5,791,642 A 8/1998 Sawano et al.
6,095,516 A 8/2000 Sawano et al.
(Continued)

FOREIGN PATENT DOCUMENTS

JP 3-95065 A 4/1991
JP 7-179259 A 7/1995
(Continued)

OTHER PUBLICATIONS

Office action dated Dec. 20, 2016 in related JP Application No. 2015-216138, including Eng. translation 4pp.
(Continued)

*Primary Examiner* — Prasad V Gokhale
(74) *Attorney, Agent, or Firm* — Lewis Roca Rothgerber Christie LLP

(57) ABSTRACT

A paper ejection tray assembly for ejecting paper in an ejecting direction in an image reading device includes a tray body including a stacking surface for stacking an ejected paper, and a pair of movable ribs which are arranged a predetermined distance apart from each other in a direction perpendicular to the ejection direction of the paper and which project out from the stacking surface of the tray body at least when paper is ejected from an ejection slot, the pair of ribs respectively have first inclined surfaces with heights from the stacking surface gradually becoming higher from the downstream side toward the upstream side of the ejection direction of the paper so as to guide the paper ejected from the ejection slot.

11 Claims, 10 Drawing Sheets

(51) Int. Cl.
*B65H 31/02* (2006.01)
*B65H 31/26* (2006.01)

(52) U.S. Cl.
CPC ..... *B65H 2301/4212* (2013.01); *B65H 2301/51214* (2013.01); *B65H 2402/343* (2013.01); *B65H 2402/46* (2013.01); *B65H 2405/1114* (2013.01); *B65H 2405/1115* (2013.01); *B65H 2405/11151* (2013.01); *B65H 2405/11152* (2013.01); *B65H 2405/11161* (2013.01); *B65H 2405/11164* (2013.01); *B65H 2405/1412* (2013.01); *B65H 2801/06* (2013.01); *B65H 2801/39* (2013.01)

(58) Field of Classification Search
CPC ..... B65H 2405/111; B65H 2405/1111; B65H 2405/1112; B65H 2405/1113; B65H 2405/11131; B65H 2405/1114; B65H 2405/11141; B65H 2405/1115; B65H 2405/11151; B65H 2405/11152; B65H 2405/1116; B65H 2405/11161; B65H 2405/11162; B65H 2405/11164; B65H 2405/1117; B65H 2405/1412; B65H 2511/12
USPC ..... 271/209, 211, 213, 217–219, 223
See application file for complete search history.

(56) References Cited

U.S. PATENT DOCUMENTS

| | | | | |
|---|---|---|---|---|
| 6,659,454 | B1 | 12/2003 | Smith et al. | |
| 8,210,527 | B2 * | 7/2012 | Kawaguchi | B65H 29/242 271/188 |
| 8,448,942 | B2 | 5/2013 | Otani et al. | |
| 9,162,842 | B2 * | 10/2015 | Komuro | B65H 31/20 |
| 2001/0015144 | A1 * | 8/2001 | Tsurumaki | B65H 29/70 101/232 |
| 2002/0051668 | A1 * | 5/2002 | Kono | B41J 13/106 400/582 |
| 2006/0017219 | A1 * | 1/2006 | Yamada | B65H 31/02 271/209 |
| 2008/0067737 | A1 * | 3/2008 | Kosuda | B65H 31/02 271/207 |
| 2010/0289206 | A1 * | 11/2010 | Yoshino | B41J 13/0063 271/3.14 |
| 2011/0285077 | A1 * | 11/2011 | Otani | B65H 31/02 271/213 |
| 2013/0307211 | A1 * | 11/2013 | Morita | B65H 31/00 271/207 |
| 2014/0151957 | A1 * | 6/2014 | Ono | B65H 31/02 271/207 |
| 2014/0300048 | A1 * | 10/2014 | Nakamura | B65H 31/02 271/209 |
| 2014/0319760 | A1 | 10/2014 | Komuro | |
| 2014/0321877 | A1 * | 10/2014 | Ono | G03G 21/206 399/92 |
| 2015/0274475 | A1 * | 10/2015 | Ohta | B65H 29/22 271/306 |
| 2016/0154358 | A1 * | 6/2016 | Hashimoto | B65H 31/20 271/213 |
| 2016/0185551 | A1 * | 6/2016 | Ito | B65H 29/14 271/306 |
| 2016/0347570 | A1 | 12/2016 | Sugiyama et al. | |

FOREIGN PATENT DOCUMENTS

| | | | |
|---|---|---|---|
| JP | 11-165935 | A | 6/1999 |
| JP | 2000-327204 | A | 11/2000 |
| JP | 2004-26370 | A | 1/2004 |
| JP | 2006-27758 | A | 2/2006 |
| JP | 2007-246281 | A | 9/2007 |
| JP | 2013-237544 | A | 11/2013 |

OTHER PUBLICATIONS

Office action dated Dec. 20, 2016 in related JP Application No. 2015-216143, including Eng. translation 6pp.
Office action dated Mar. 24, 2017 issued U.S. Appl. No. 15/174,874, 8 pages.
Office Action for Chinese Patent Application No. 201610607190.2 corresponding to U.S. Appl. No. 15/174,874 relating to U.S. Appl. No. 15/174,878, dated Aug. 1, 2017, 6 pages (with English translation, 7 pages).
JP Patent Office Action dated Apr. 24, 2017 (mailed May 9, 2017) regarding JP Patent Application No. 2015-216138 corresponding to U.S. Appl. No. 15/174,874 relating to U.S. Appl. No. 15/174,878, (2 pages) with English translation (2 pages).
JP Patent Office Action dated Apr. 24, 2017 (mailed May 9, 2017) regarding JP Patent Application No. 2015-216143 corresponding to U.S. Appl. No. 15/174,878, (3 pages) with English translation (3 pages).
Advisory Action dated Nov. 9, 2017 from related U.S. Appl. No. 15/174,874.
Interview Summary dated Nov. 9, 2017 from related U.S. Appl. No. 15/174,874.
Office Action for U.S. Appl. No. 15/174,874 (dated Jul. 21, 2017), 27 pages.
CN Office Action dated Aug. 16, 2017 regarding CN Patent Application No. 2016106007200.2 corresponding to U.S. Appl. No. 15/174,878 (7 pages) with English translation (6 pages).
Chinese Office Action dated Mar. 22, 2018 regarding Chinese Patent Application No. 201610607190.2 corresponding to U.S. Appl. No. 15/174,874 relating to U.S. Appl. No. 15/174,878 (6 pages) with English Translation (7 pages). (Please note that U.S. Pat. No. 6095516 is described as "comparison document 2" on p. 1 and U.S. Pat. No. 5791642 is described as "comparison document 2" on p. 3 of the Office Action).

* cited by examiner

PAPER EJECTION TRAY ASSEMBLY WITH RIBS

CROSS-REFERENCE TO RELATED APPLICATIONS

This application is based upon and claims the benefit of priority of prior Japanese Patent Application No. 2015-216143, filed on Nov. 2, 2015, the entire contents of which are incorporated herein by reference.

TECHNICAL FIELD

Embodiments discussed in the present specification relates to a paper ejection tray assembly which stacks ejected paper.

BACKGROUND

In a paper ejection tray assembly which is attached to an image reading apparatus or image copying apparatus etc., the phenomenon of paper being ejected from the ejection slot, then the front end part of the paper not being able to advance over a stacking surface of the paper ejection tray assembly or the stacked paper and therefore being bent, i.e., so-called buckling, occurred, and a paper eject jam (paper jam) sometimes occurred. Further, at the time of paper ejection, sometimes not only did the ejected paper buckle, but also the force by which the ejected paper was ejected and the friction between sheets of paper caused stacked paper to be pushed and the paper to fall to the floor.

To prevent buckling of paper at the time of ejection, in the past (1) the landing angle when the paper landed on the paper ejection tray assembly was made smaller, (2) the height from the ejection slot to the paper ejection tray assembly was made smaller, (3) in the ejection slot, paper eject rollers etc. were used to stiffen the paper in the longitudinal direction (paper ejection direction), and other attempts have been made. However, if, like in (1), making the landing angle smaller to an extent where buckling does not occur, the inclination angle of the paper ejection tray assembly also became smaller, so the stacked paper was not aligned at the rear ends and a stopper became necessary at the back end of the paper ejection tray assembly. For this reason, the length of the paper ejection tray assembly became greater than the length of the paper, the paper ejection tray assembly became larger, and the user was consequently inconvenienced. Further, if, like in (2), lowering the height from the ejection slot to the paper ejection tray assembly, the load when the paper landed on the paper ejection tray assembly became smaller, but there was the problem that the maximum stacked capacity of the paper was reduced compared with the past. Further, if, like in (3), using paper eject rollers for stiffening, if the ejection slot and the image reading position were close, the stiffening given at the ejection slot also had an effect on the reading of the image, so a large stiffness could not be given. Further, due to stiffening, the push-off force at the time of ejection increased, so there was the problem that the factors pushing off paper stacked on the paper ejection tray assembly increased.

As the method for prevent push-off and fall-off of the stacked paper, attempts have been made such as providing a stopper at the end of the paper ejection tray assembly and physically stopping the paper which is pushed off or increasing the angle at which the paper ejection tray assembly is set (increasing the inclination angle). However, with each method, push-off and consequent fall-off are prevented, but providing a stopper increases the size of the paper ejection tray assembly and inconveniences the user. Further, when increasing the setting angle, the friction when the ejected paper passes over the stacked paper also increases, so there was the possibility of the paper buckling.

Further, as art for stacking the ejected paper, Japanese Patent Publication No. 2000-327204A discloses forming a cutaway part in a sheet stacking surface which stacks the sheets, providing a movable sheet receiver which can move up and down in this cutaway part, and allowing the movable sheet receiver to descend due to its own weight in accordance with the increase of the number of sheets which are ejected to the sheet stack table so that even curled sheets can be smoothly stacked without reducing the maximum sheet stacking capacity. However, in the art which is described in Japanese Patent Publication No. 2000-327204A, the paper could not be given sufficient stiffness and paper eject jams could occur.

Japanese Patent Publication No. 7-179259A discloses an image forming apparatus in which, when pulling out a slide tray part, a rib-shaped projection is pushed upward for the purpose of preventing an ejected sheet from falling off from a paper ejection tray and enabling stacking to a suitable position at all times. The stacked paper is pushed upward by the rib-shaped projection, but the stacked paper could be pushed off due to friction with the ejected paper.

SUMMARY

It is still desired to provide a paper ejection tray assembly which prevents buckling and push-off of the paper.

A paper ejection tray assembly according to an embodiment of the present invention is a paper ejection tray assembly which is provided below an ejection slot which ejects paper, which system is comprised of a tray body which has a stacking surface for stacking ejected paper and a pair of ribs which are arranged a predetermined width apart in a direction perpendicular to the ejection direction of the paper and which project out from the stacking surface of the tray body at least when paper is ejected from the ejection slot, wherein the pair of ribs respectively have first inclined surfaces with heights from the stacking surface gradually becoming higher from the downstream side toward the upstream side of the ejection direction of the paper so as to guide the paper which is ejected from the ejection slot.

DESCRIPTION OF EMBODIMENTS

Below, a paper ejection tray assembly according to an embodiment of the present invention will be explained while referring to the figures. In the following embodiments, the same or similar components will be shown with common reference notations. To facilitate understanding, these figures are suitably changed in scale. Further, please note the technical scope of the present invention is not limited to these embodiments and that it extends to inventions which are described in the claims and their equivalents.

Figure 1:
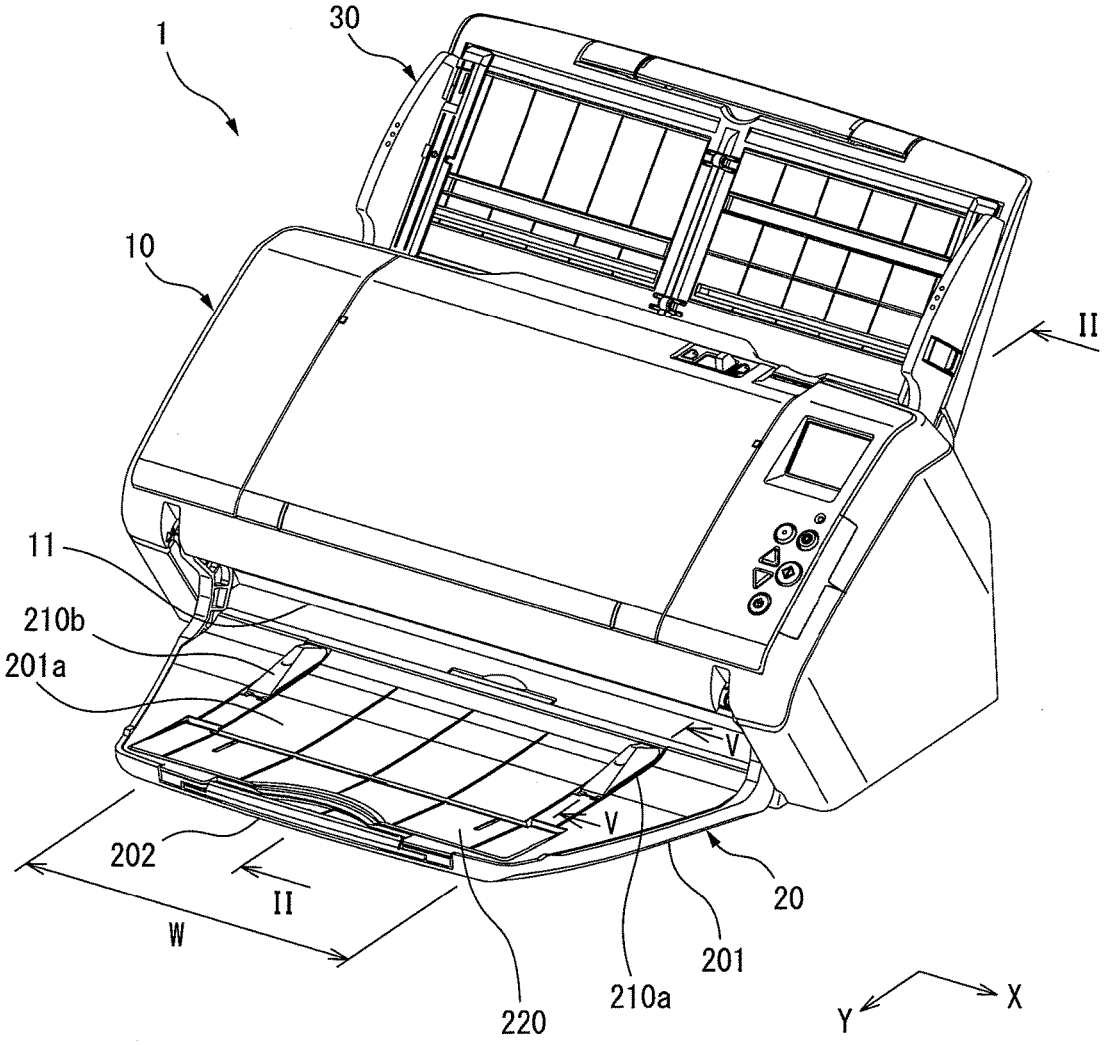
FIG. 1 is a perspective view showing an image reading apparatus 1 to which a paper ejection tray assembly 20 is attached.
Figure 2:
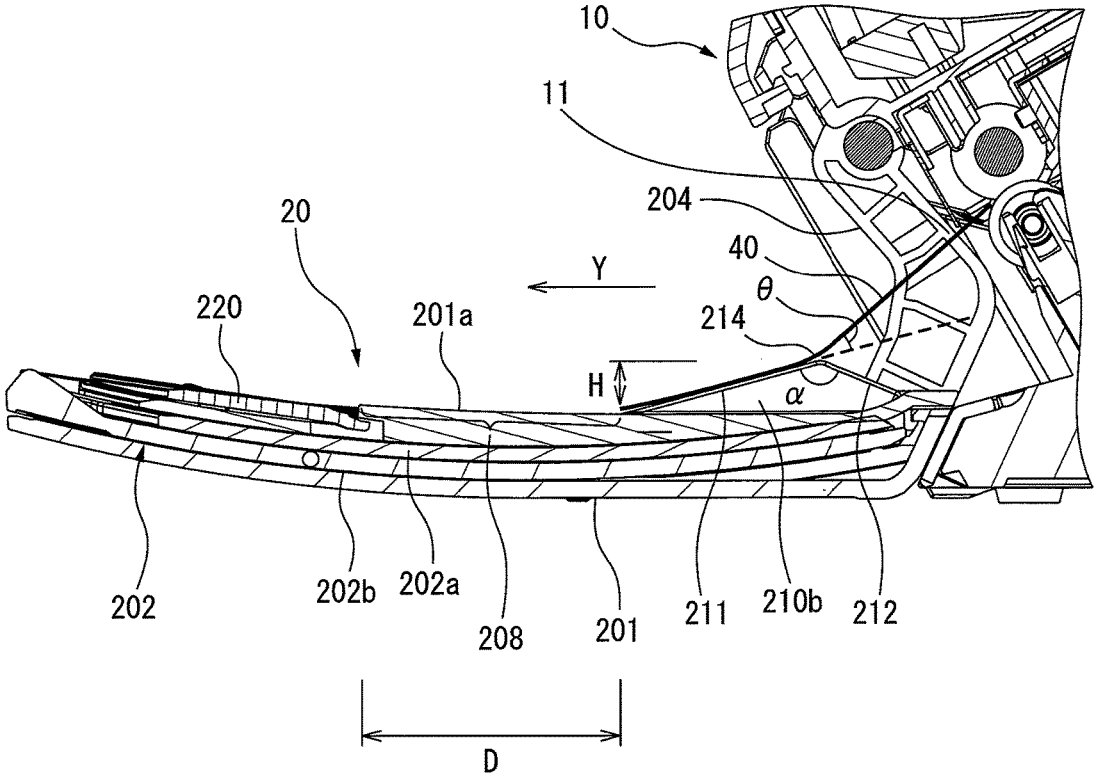
FIG. 2 is a cross-sectional view along line II-II of FIG. 1 showing an ejection slot and paper ejection tray assembly 20 of an image reading apparatus.

FIG. 1 is a perspective view showing an image reading apparatus 1 to which a paper ejection tray assembly 20 of the present embodiment is attached. FIG. 2 is a cross-sectional view along line II-II of FIG. 1 showing a state where the paper ejection tray assembly 20 is attached to a reading apparatus body 10 of the image reading apparatus 1.

The image reading apparatus 1 is comprised of the reading apparatus body 10 which conveys a document (below, called "paper 40") while reading the image, a paper feed system 30 which continuously feeds a plurality of sheets of paper 40 to the reading apparatus body 10, an ejection slot 11 which ejects the paper 40 which is read by the reading apparatus body 10, and a paper ejection tray assembly 20 which stacks the plurality of sheets of paper 40 which were ejected from the ejection slot 11. Further, the illustrated image reading apparatus 1 of the embodiment is configured to be able to be made more compact by folding up the paper ejection tray assembly 20 when not in use.

The image reading apparatus 1 in which the paper ejection tray assembly 20 is attached is one example. So long as an apparatus which ejects paper from an ejection slot 11, the apparatus to which the paper ejection tray assembly 20 is attached may be an ink jet printer or other printing apparatus or an image copying apparatus. The paper eject mechanism of the reading apparatus body 10 of the image reading apparatus 1 and the paper feed mechanism of the paper feed system 30 can be replaced with conventional mechanisms, so detailed explanations will be omitted.

The paper ejection tray assembly 20 is configured so as to be supported by arms 204 which are connected to the reading apparatus body and so as to be provided under the ejection slot 11 of the reading apparatus body 10 which ejects the paper 40, in an ejection direction of the paper 40 (arrow Y-direction of FIGS. 1 and 2) in the image reading apparatus 1, when the image reading apparatus 1 is being used. The paper ejection tray assembly 20 comprises a tray body 201 which includes a stacking surface 201*a* for stacking the ejected paper 40 and a pair of movable ribs 210*a*, 210*b* which are arranged a predetermined width W apart (in other words, a predetermined distance apart from each other) in a direction (arrow X direction of FIG. 1) perpendicular to the ejection direction of the paper 40 (arrow Y-direction of FIGS. 1 and 2) and which project out from the stacking surface 201*a* of the tray body 201 when the paper 40 is ejected from the ejection slot 11.

Further, the projecting pair of ribs 210*a*, 210*b* respectively have first inclined surfaces 211 which gradually become higher in heights from stacking surface 201*a* from the downstream side to the upstream side of the ejection direction of the paper 40 so as to guide the paper 40 which is ejected from the ejection slot 11. Further, the pair of ribs 210*a*, 210*b* respectively have second inclined surfaces 212 which gradually become higher in heights from the stacking surface 201*a* from the upstream side to the downstream side of the ejection direction of the paper. The pair of ribs 210*a*, 210*b* are formed so that the angle $\alpha$ between the first inclined surfaces 211 and second inclined surfaces 212 become 90 degrees or more, that is, an obtuse angle.

The pair of ribs 210*a*, 210*b* are arranged so that the paper 40 which is ejected from the ejection slot 11 lands on the first inclined surfaces 211 of the pair of ribs 210*a*, 210*b* when ejected as shown in FIG. 2. The front end of the paper 40 does not directly land on the stacking surface 201*a* of the tray body 201. Further, the first inclined surfaces 211 are inclined, so the landing angle $\theta$ on the first inclined surfaces can be made smaller than the landing angle when the paper 40 directly lands on the stacking surface 201*a*. For the front end of the paper 40 which is ejected from the ejection slot 11 to land on the first inclined surfaces 211, the back ends of the pair of ribs 210*a*, 210*b*, that is, the end parts of the downstream side, should be set at positions so that the distances from the ejection slot 11 become 0 mm to 30 mm.

The angle $\alpha$ between the first inclined surfaces 211 and the second inclined surfaces 212 is an obtuse angle, so, for example, even if the front end of the ejected paper 40 curls downward, it does not catch on the top parts 214 of the ribs and can be pushed back to the first inclined surface 211 sides to thereby enable buckling to be prevented. If the angle $\alpha$ is smaller than 90 degrees, if the front end of the paper curls downward, it will descend along the second inclined surfaces 212 and buckling may occur.

Further, the pair of ribs 210*a*, 210*b* are, as shown in FIG. 1, arranged a predetermined width apart. This width W is preferably based on the size of the paper with a high frequency of being ejected. It is determined so that the side parts 40*a*, 40*b* of the paper 40 (see FIG. 3) strike the first inclined surfaces 211. If the size of the covered paper is the A3 size, the pair of ribs 210*a*, 210*b* are preferably arranged assuming a size of a width W of 150 mm to 290 mm or less. Further, if the size of the covered paper is the A4 size, the pair of ribs 210*a*, 210*b* are preferably arranged assuming a size of a width W of 100 mm to 200 mm or less.

Figure 3:
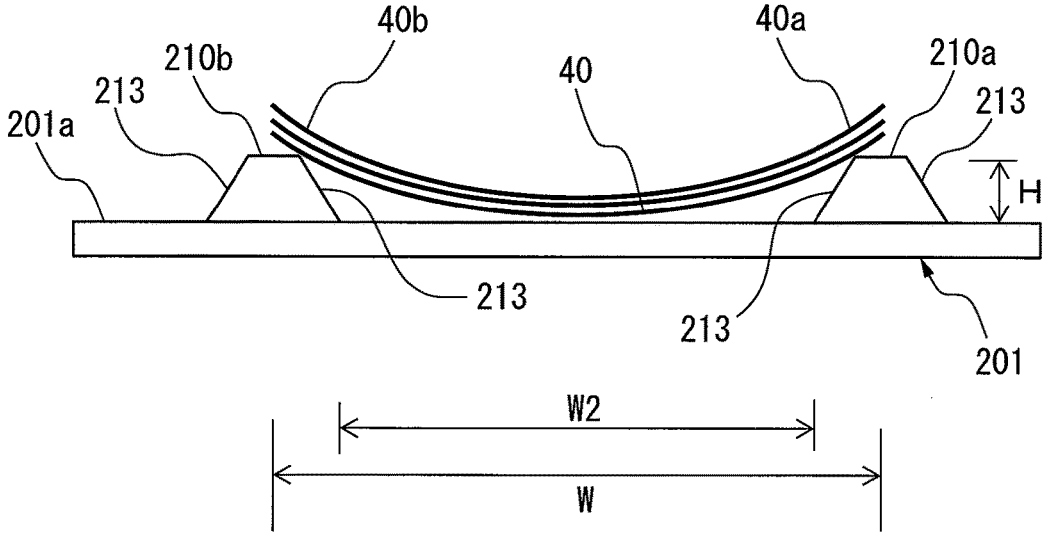
FIG. 3 is a schematic view showing the state at which ribs are used to stiffen the paper.

FIG. 3 is a schematic view showing the state where the pair of ribs 210*a*, 210*b* are used to stiffen the paper. As shown in FIG. 3, by arranging the pair of ribs 210*a*, 210*b* a predetermined width apart on the tray body, at the time of paper ejection, the paper 40 is supported at its side parts 40*a*, 40*b* by the ribs 210*a*, 210*b* and the paper 40 is bent in a recessed shape in the width direction (arrow X direction of FIG. 1) to stiffen it. The paper 40 which is stiffened as shown in FIG. 3 becomes difficult to bend in the paper ejection direction (arrow Y-direction of FIG. 1), so buckling is prevented.

Further, the pair of ribs 210*a*, 210*b* are arranged along the paper ejection direction (arrow Y-direction of FIG. 1) of the tray body 201 line symmetrically with respect to the center axis of the paper ejection tray assembly 20. This is because the paper feed system 30 is a system which feeds the paper 40 with reference to the center. According to this, paper is ejected with reference to the center of the paper ejection tray assembly 20. When the paper feed system 30 is a paper feed system which feeds paper with reference to one side, the pair of ribs are arranged with reference to the paper eject position.

Further, the pair of ribs 210*a*, 210*b* have two side surfaces 213 which are arranged inclined to the left and right of the first inclined surfaces 211. By the two side surface 213 being inclined as shown in FIG. 3, for example, even when paper with a width of a size somewhat larger than the width W2 of the inside of the pair of ribs 210*a*, 210*b* is ejected, the two side parts of the paper contact the corresponding side surfaces 213. Due to this, the paper is stiffened, the load on the front end of the paper at the time of paper ejection is reduced, and buckling is prevented.

Figure 4A:
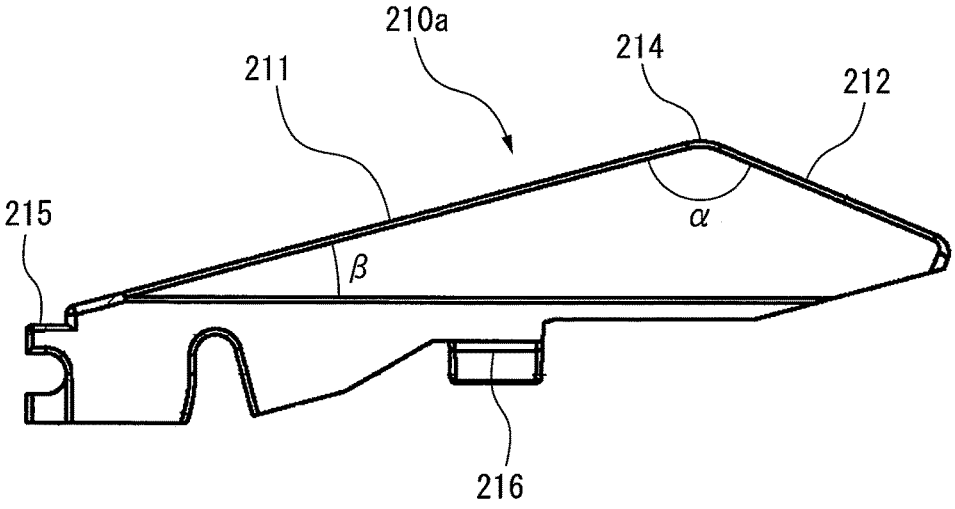
FIG. 4A is a view of the side surface of a rib.
Figure 4B:
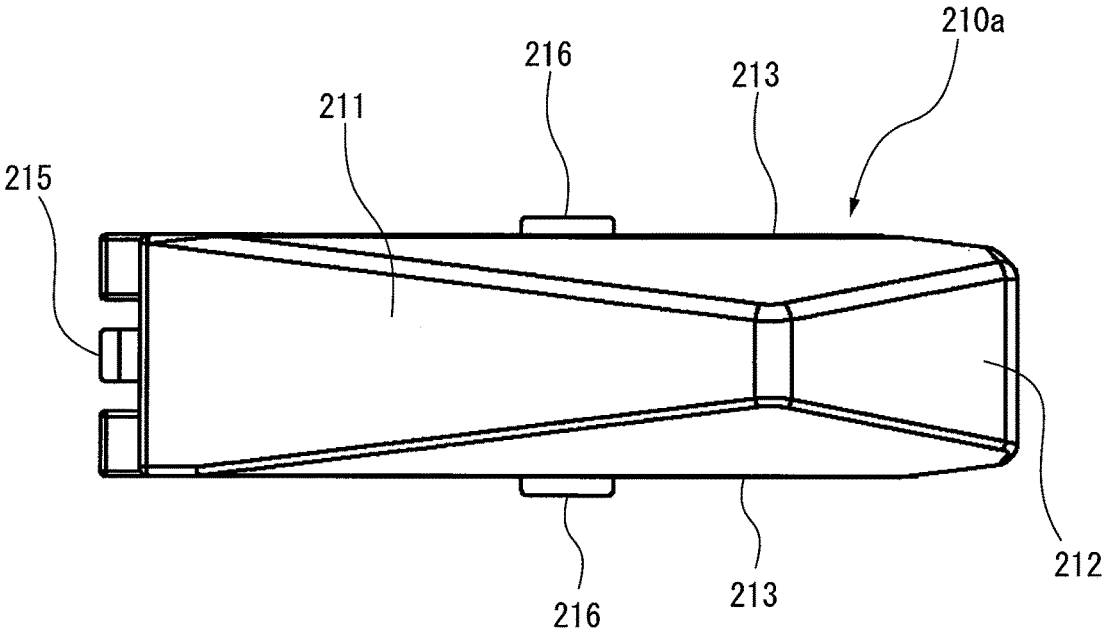
FIG. 4B is a plan view of a rib.

The pair of ribs 210*a*, 210*b* are respectively configured to be able to be stored in the tray body 201. FIG. 4A shows the side surface of the rib 210*a* in the state before being attached to the tray body 201, while FIG. 4B shows a plan view of the rib 210*a*. The rib 210*b* is formed in the same shape as the rib 210*a*, so an explanation therefore will be omitted.

As shown in FIG. 4A and FIG. 4B, the bottom part of the rib 210*a* is provided with a gripping part 215 which grips a rotary shaft 207 which is formed at the tray body 201 (see FIG. 5) at the end part in the downstream side of the paper ejection direction and stoppers 216 at the left and right of the bottom part of the rib 210*a*.

Figure 5A:
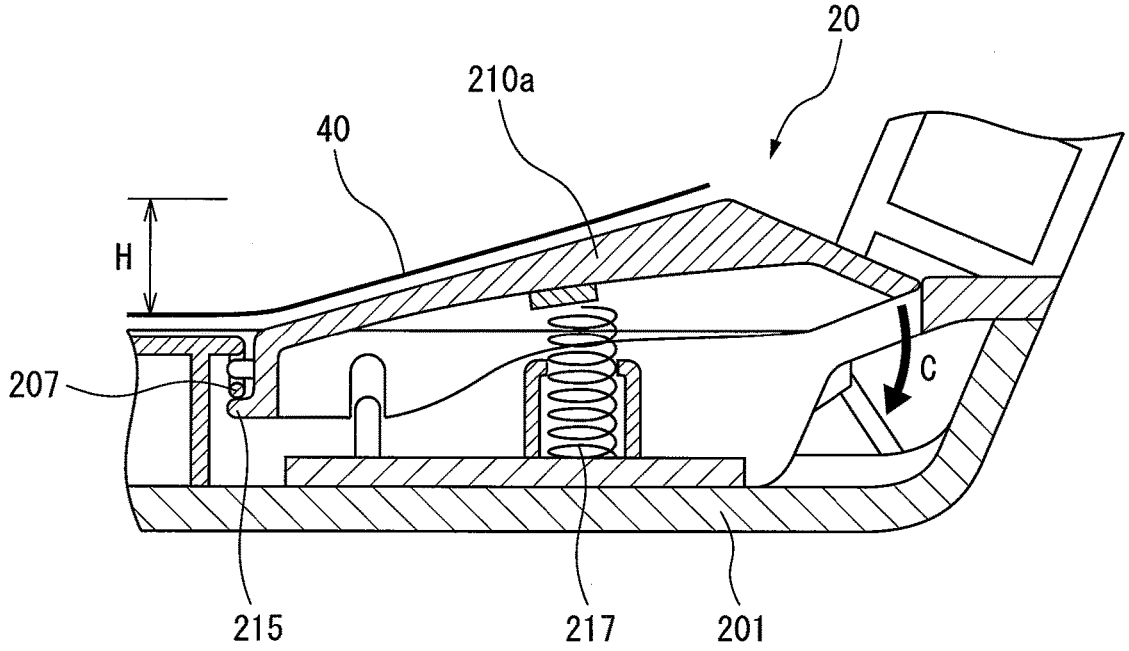
FIG. 5A is a cross-sectional view along the line V-V of FIG. 1 and a cross-sectional view showing the state at which ribs are attached to the paper ejection tray assembly 20.
Figure 5B:
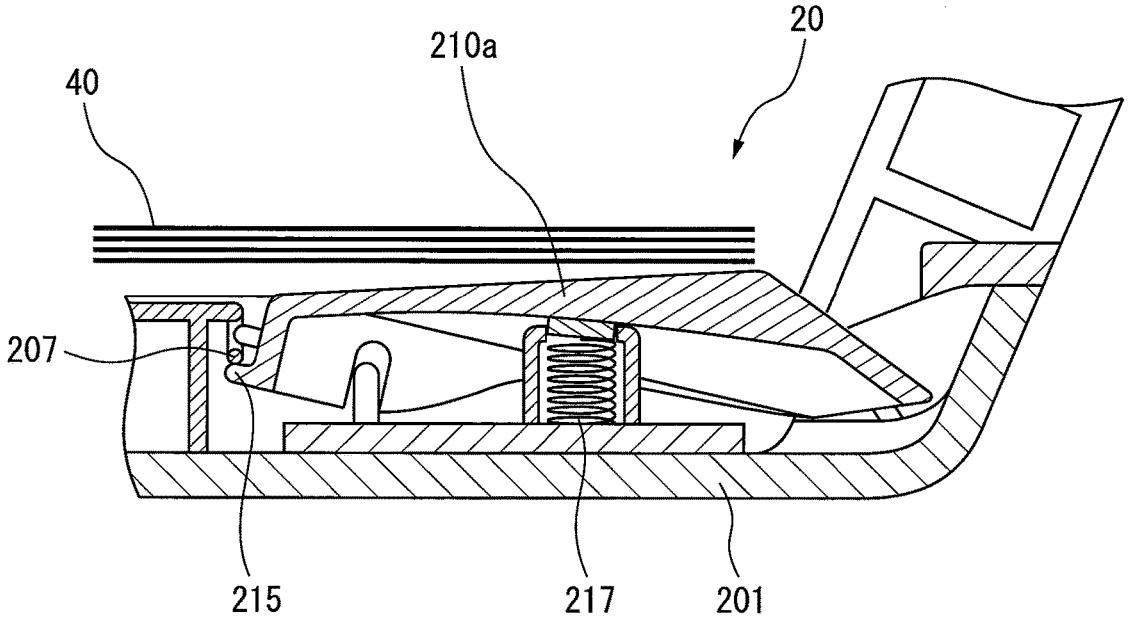
FIG. 5B is a cross-sectional view showing the state at which ribs are stored in the paper ejection tray assembly 20.

FIG. 5A is a cross-sectional view along the line V-V of FIG. 1 and a cross-sectional view showing the state where the rib 210*a* is attached to the tray body 201. FIG. 5B is a view showing the state where the rib 210*a* descends due to the load of the paper which is stacked on the tray body 201 and is stored inside the tray body 201. As shown in FIG. 5A, the gripping part 215 of the rib 210*a* grips the rotary shaft 207 which is provided at the tray body 201. The rib 210*a* is attached to be able to pivot about the rotary shaft 207 in the arrow C direction of FIG. 5A. Further, the bottom part of the rib 210*a* is supported by a coil spring 217 (elastic member) which is provided at the tray body 201. For this reason, even when a certain number of sheets of paper are stacked on the rib 210*a*, the height H of the rib 210*a* does not change. Further, if the number of sheets of the paper 40 which are stacked on the rib 210*a* increases by a predetermined number of sheets, the rib 210*a* pivots downward and the height H of projection of the rib 210*a* gradually becomes lower. Further, finally, the rib 210*a* is stored inside the tray body 201. The stacked paper reduces the height of the rib 210*a*, so it is possible to realize a maximum number of sheets stacked similar to the past.

The coil spring 217 which supports the rib 210*a* is one example of the elastic member. The coil spring 217 may also be rubber. Further, at the left and right of the bottom part of the rib 210*a*, stoppers 216 which abut against the tray body 201 are provided, so the rib 210*a* will not rise up from the tray body 201 even if the rib 210*a* is biased upward by the coil spring 217.

Note that, the rib 210*a* shown in the figure is provided with the rotary shaft 207 (pivot point) at the downstream side in the paper ejection direction, but it may also be provided with the rotary shaft 207 at the upstream side. Providing the rotary shaft 207 at the downstream side like in the illustrated embodiment is preferable since the rib 210*a* which easily receives the load from the stacked paper 40 easily descends.

The height H by which the rib 210*a* projects out from the stacking surface 201*a* is preferably 5 mm or more so as to sufficiently stiffen the paper 40. The height H of the rib 210*a* is limited in accordance with the thickness of the tray body 201 considering the fact that the rib 210*a* is stored in the tray body 201.

Further, the angle β of inclination of the first inclined surface 211 or the rib 210*a* with respect to the stacking surface 201*a* (see FIG. 4) shown in the figure is formed to 15 degrees. The angle β of inclination may be formed so that the inclination angle becomes 10 degrees to 20 degrees so that buckling does not occur when the front end of the ejected paper 40 moves to the stacking surface 201*a*.

Next, returning to FIG. 1 and FIG. 2, the flap part 220 which the paper ejection tray assembly 20 is provided with will be explained.

The paper ejection tray assembly 20 of the present embodiment further has a slide tray part 202 which is provided to be able to be pulled out at the downstream side of the tray body 201 in the paper ejection direction and a flap part 220 which moves to an inclined position linked with the operation of the slide tray part 202 being pulled out from the tray body 201.

The flap part 220 is arranged at a downstream side of the ejection direction of the paper 40 (arrow Y-direction) via a flat part 208 of the stacking surface 201*a* which has a predetermined width D with respect to the pair of ribs 210*a*, 210*b*.

Figure 6:
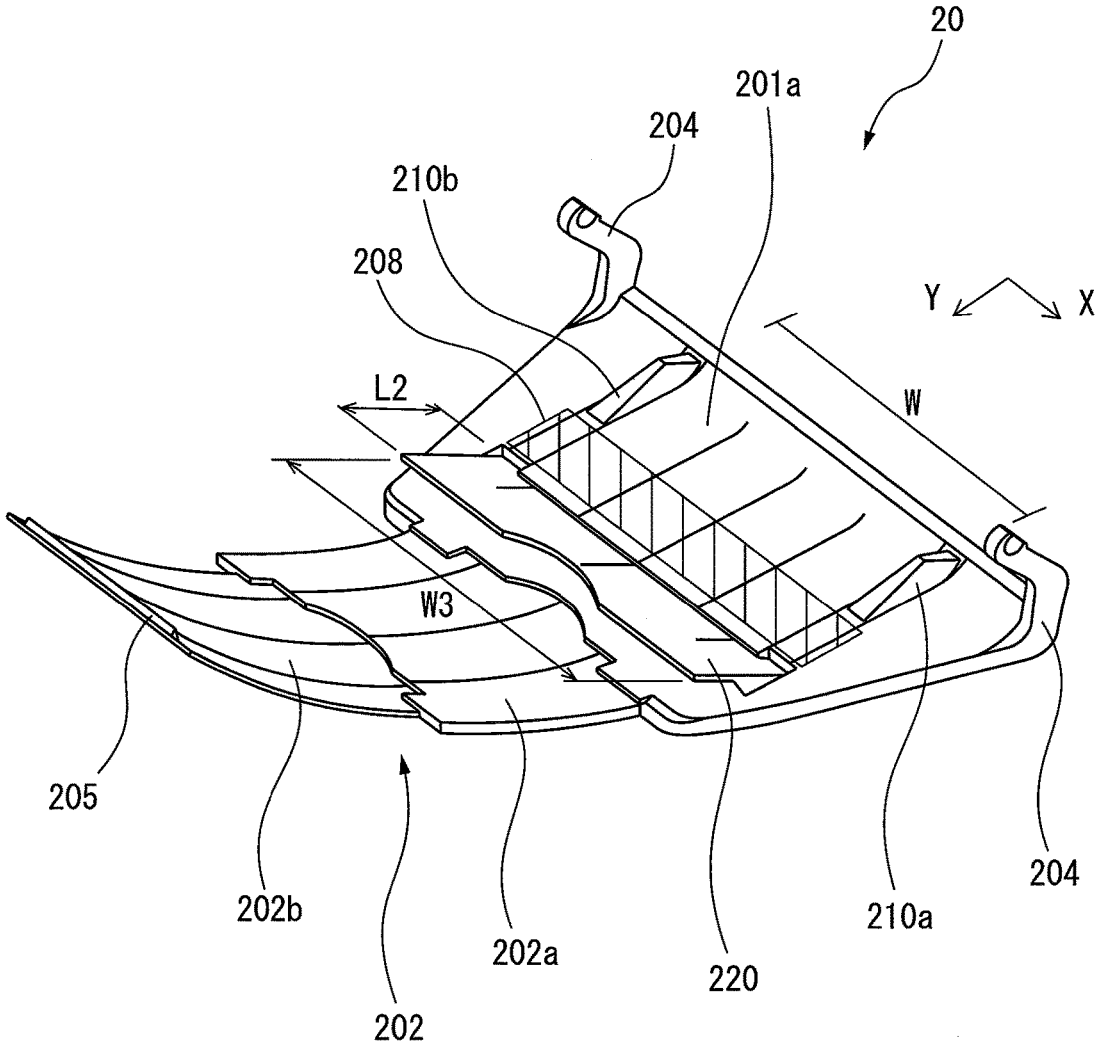
FIG. 6 is a perspective view showing a paper ejection tray assembly 20 showing the state where a slide tray part 202 is pulled out.
Figure 7:
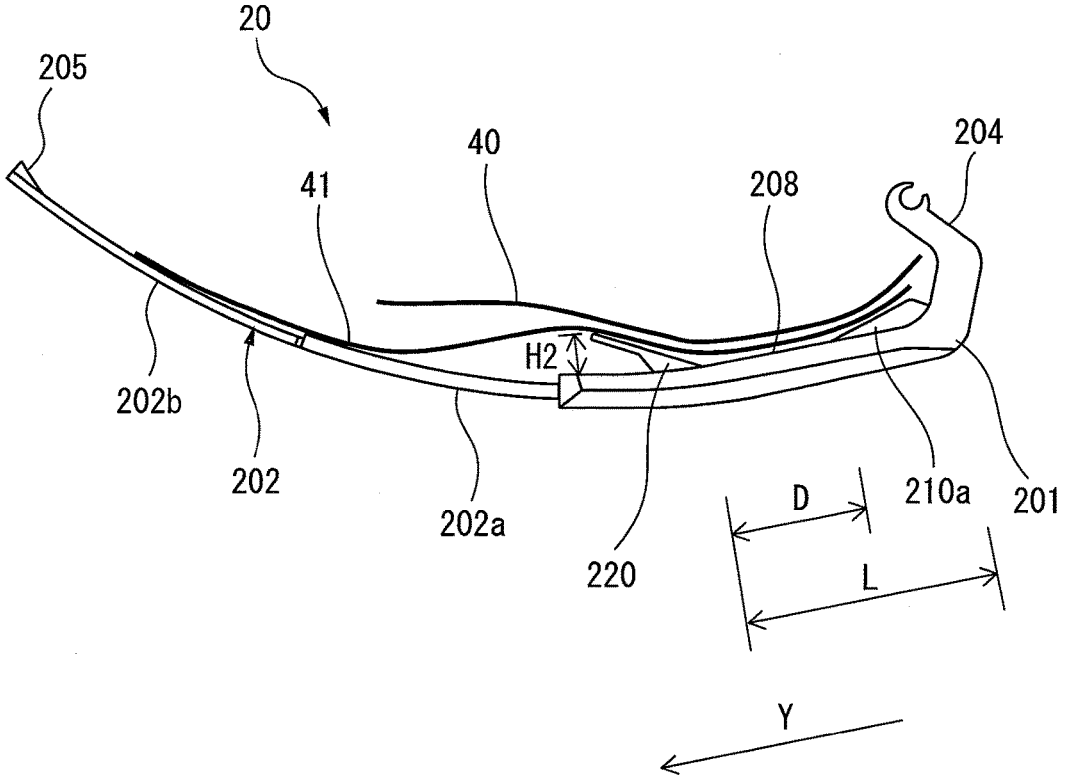
FIG. 7 is a side surface view of a paper ejection tray assembly 20 showing the state where the slide tray part 202 is pulled out and a view showing the state where paper is stacked on the paper ejection tray assembly 20.

FIG. 6 is a perspective view of the paper ejection tray assembly 20 showing the state of pulling out the slide tray part 202 which is provided at the tray body 201, while FIG. 7 is a side surface view of the same.

The slide tray part 202 is comprised of a first slide part 202*a* which slides out from the tray body 201 and a second slide part 202*b* which slides out from the first slide part 202*a*. At the end part of the second slide part 202*b* at the downstream side, a handle 205 is provided. The user can pull the handle 205 to pull out the slide tray part 202 from the tray body 201 by a force.

The flap part 220 of the tray body 201 moves to the inclined position linked with the slide tray part 202 by the force when the slide tray part 202 is pulled out. The flap part 220 is arranged so that, at the inclined position, the height of the flap part 220 from the stacking surface 201*a* becomes gradually higher from the upstream side toward the downstream side of the ejection direction of the paper as shown in FIG. 6 and FIG. 7 to guide the ejected paper.

Due to the presence of the flap part 220 which inclines at the stacking surface 201*a*, as shown in FIG. 7, the ejected paper 40 is lifted upward by the flap part 220. The paper 40 which rides over the flap part 220 is raised once in the air and then lands on the slide tray part 202. At this time, the contact area with the stacked paper 41 is reduced by exactly the amount of area of the paper which is raised in the air. The contact area is reduced, so the frictional force between the stacked paper 41 and the ejected paper 40 is also reduced, so the stacked paper 41 does not move due to the ejected paper 40 and push-off can be reduced.

The flap part 220 is a plate-shaped member such as shown in FIG. 6. It is configured so as to lift up the entire ejected paper 40 in its width direction (arrow X direction of FIG. 6). To make the paper 40 rise up once in the air, the length W3 in the width direction is preferably 50 mm or more, while the length L2 in the ejection direction is preferably 20 mm or more.

Further, the height H2 from the stacking surface of the end part of the downstream side of the flap part 220 at the inclined position is preferably 10 mm to 40 mm, while the inclination angle β2 of the flap part 220 (see FIG. 8B) is preferably 10 degrees to 30 degrees. If the height H2 is lower than 10 mm or the inclination angle β2 is smaller than 10 degrees, the area of the paper 40 which is raised up in the air becomes smaller and therefore the effect of reducing the friction between the sheets of paper is difficult to obtain. If the height H2 is higher than 40 mm or the inclination angle β2 is larger than 30 degrees, the paper 40 cannot climb up the flap part 220. Further, the paper 40 raised up in the air lands on the slide tray part 202 by an acute angle, so the front end of the paper 40 is liable to end up buckling.

Regarding the position where the flap part 220 is set, when A3 size paper is covered, the length L from the ejection slot 11 to the upstream side end part of the flap part 220 (see FIG. 7) is preferably made 80 mm to 160 mm. Further, when A4 size paper is covered, the length L may be made 50 mm to 120 mm.

Figure 8A:
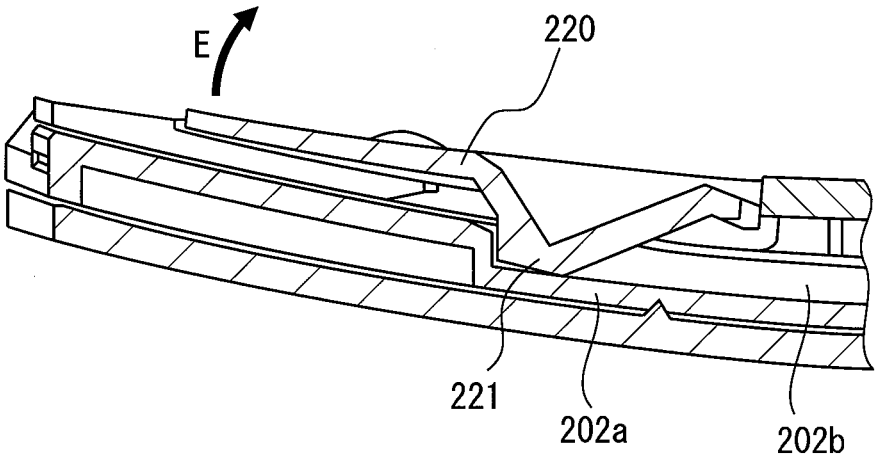
FIG. 8A is a cross-sectional view showing the state where a flap part 220 is stored in the paper ejection tray assembly 20.
Figure 8B:
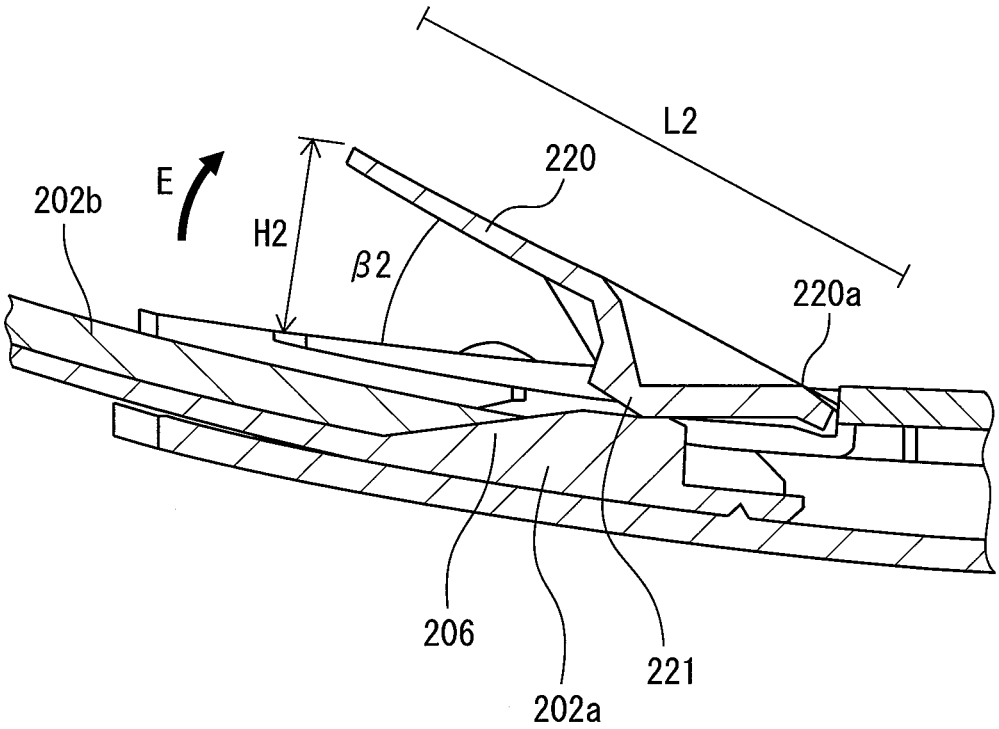
FIG. 8B is a cross-sectional view showing the state where the slide tray part 202 has been pulled out and the flap part 220 moves to an inclined position.

FIG. 8A is a cross-sectional view showing the state where the flap part 220 is held stored at the tray body 201 of the paper ejection tray assembly 20, while FIG. 8B is a cross-sectional view showing the state where the slide tray part 202 is pulled out and the flap part 220 moves to the inclined position.

As shown in FIG. 8A and FIG. 8B, the flap part 220 is provided at its back surface with a support part 221 which supports the flap part 220. Further, the first slide part 202*a* of the slide tray part 202 is provided at the upstream side end part with a projecting part 206 which engages with the support part 221 of the flap part 220 when the slide tray part 202 is pulled out. The flap part 220 is configured to rise up in the arrow E direction pivoting about the upstream side end part 220*a* if the support part 221 and the projecting part 206 are engaged. By just pulling out the slide tray part 202, the flap part 220 is raised up to the inclined position, so the user never forgets to raise up the flap part 220.

As shown in FIG. 7, the paper 41 which is lifted up by the flap part 220 and stacked becomes easier to take out due to the upward curve compared with when the ejected paper is stacked flat. Further, by being set at the inclined position, the flap part 220 performs the role as a stopper when for example paper shorter than the length of the tray body 201 in the paper ejection direction is ejected.

Figure 9:
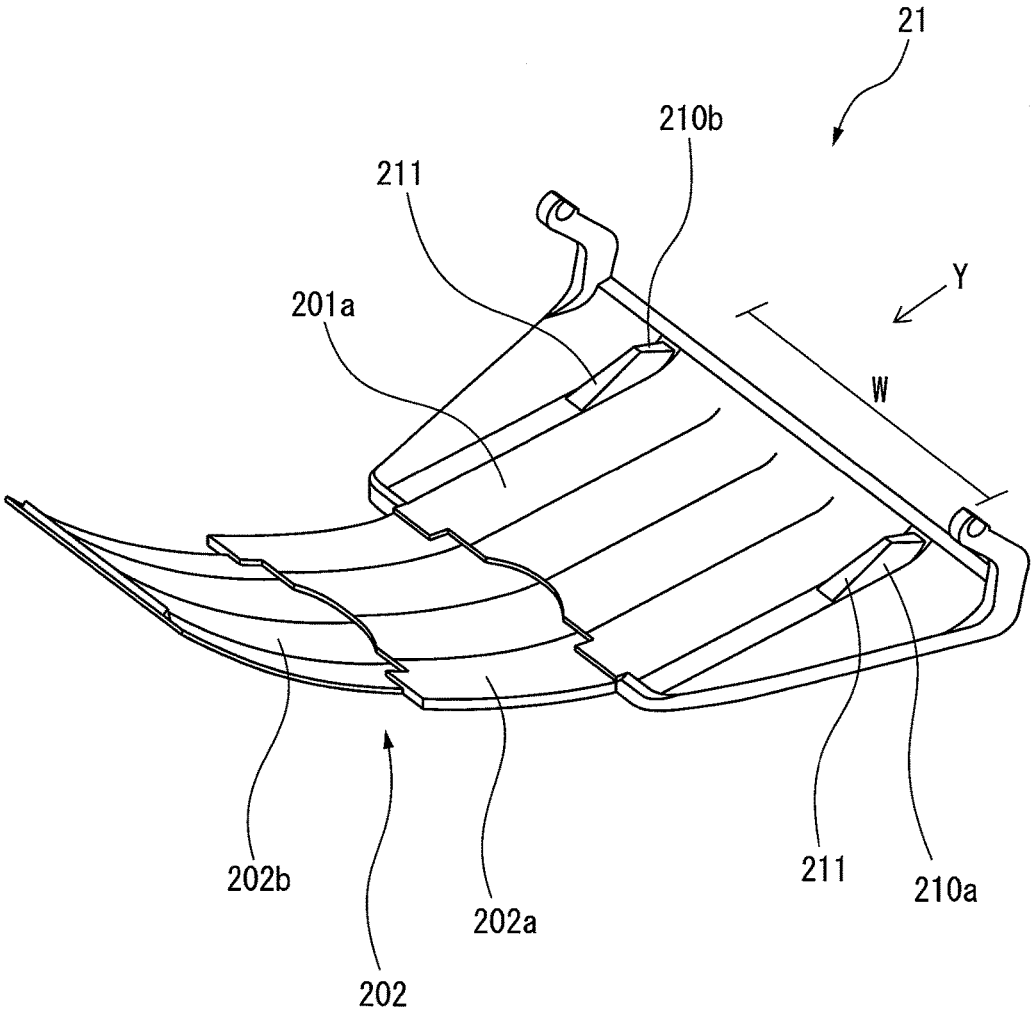
FIG. 9 is a perspective view showing a paper ejection tray assembly 21 provided with a pair of ribs.

FIG. 9 is a perspective view showing a paper ejection tray assembly 21 of an embodiment separate from the paper ejection tray assembly 20 shown in FIG. 1 to FIG. 8. The paper ejection tray assembly 21 can be provided below the ejection slot 11 of the image reading apparatus 1 shown in FIG. 1 instead of the paper ejection tray assembly 20. The paper ejection tray assembly 21 is provided with a tray body 201 which has a stacking surface 201*a* for stacking the ejected paper 40 and a pair of ribs 210*a*, 210*b* which are arranged a predetermined width apart in the direction perpendicular to the ejection direction of the paper 40 (arrow Y-direction of FIG. 9) and which project out from the stacking surface 201*a* of the tray body 201 when the paper 40 is ejected from the ejection slot 11. Further, it has a slide tray part 202 which is provided to be able to be pulled out from the tray body 201. The slide tray part 202 is comprised of a first slide part 202*a* which slides from the tray body 201 and a second slide part 202*b* which slides from the first slide part 202*a*. On the other hand, the paper ejection tray assembly 21 is not provided with the flap part 220 of the paper ejection tray assembly 20 shown in FIG. 1 to FIG. 8. The shapes and functions of the pair of ribs 210*a*, 210*b* of the paper ejection tray assembly 21 are similar to the pair of ribs 210*a*, 210*b* of the paper ejection tray assembly 20, so explanations will be omitted.

The paper ejection tray assembly 21 can be provided with a pair of ribs 210*a*, 210*b* so as to stiffen the ejected paper 40. Further, the pair of ribs 210*a*, 210*b* respectively have first inclined surfaces 211 which guide the ejected paper 40, so the landing angle when the paper 40 lands on the paper ejection tray assembly becomes smaller. For this reason, buckling of the paper 40 becomes harder to occur and in turn paper eject jams can be prevented.

Figure 10:
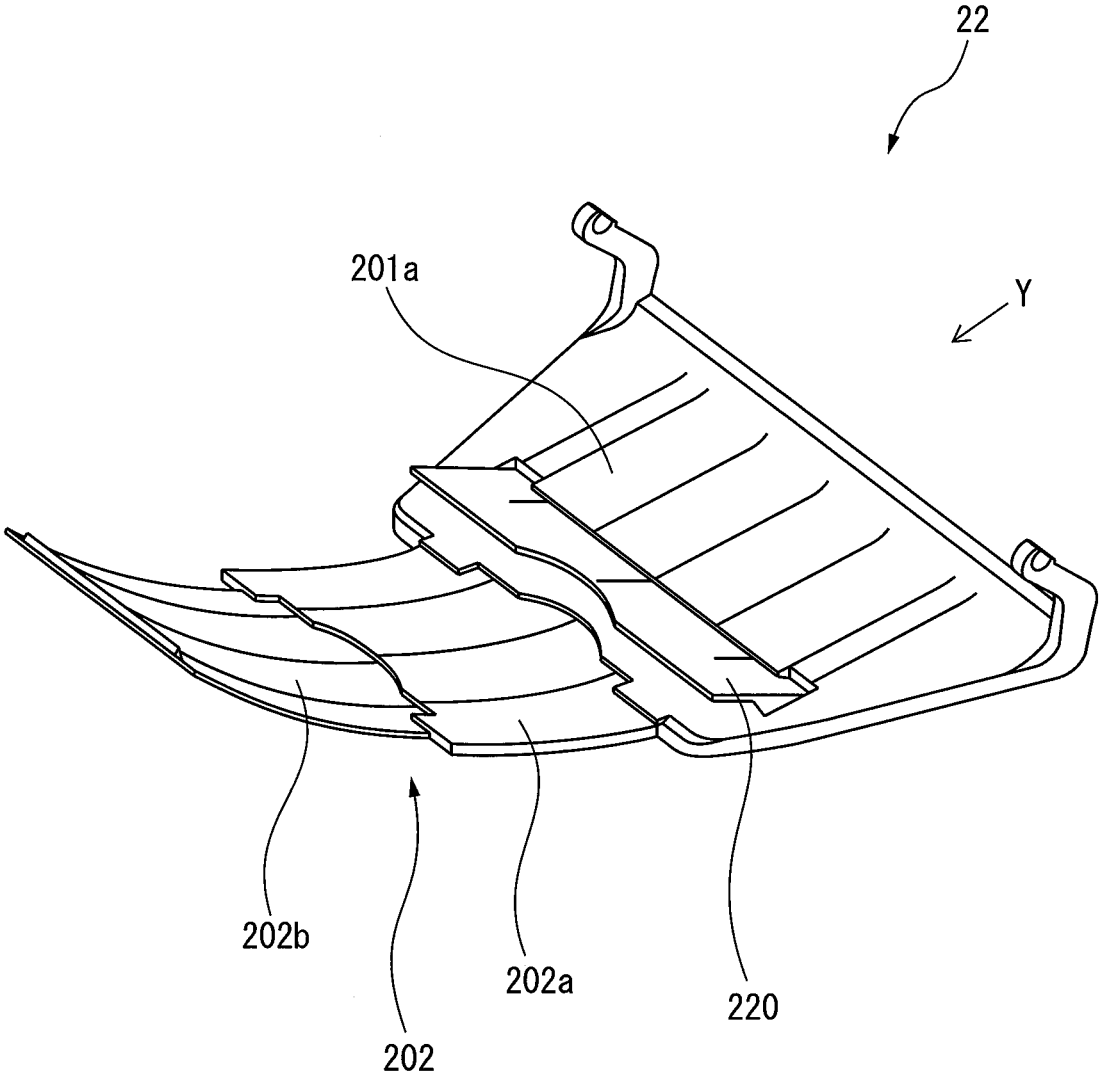
FIG. 10 is a perspective view showing a paper ejection tray assembly 22 provided with a flap part.

FIG. 10 is a perspective view showing a paper ejection tray assembly 22 of an embodiment separate from the paper ejection tray assembly 20 shown in FIG. 1 to FIG. 8. The paper ejection tray assembly 22 can be provided below the ejection slot 11 of the image reading apparatus 1 instead of the paper ejection tray assembly 20. The paper ejection tray assembly 22 has a tray body 201 which has a stacking surface 201*a* for stacking the ejected paper 40 and a slide tray part 202 which is provided to be able to be pulled out from the tray body 201. Further, a flap part 220 which moves to an inclined position linked with the operation of the slide tray part 202 being pulled out from the tray body 201 is provided. The flap part 220 is arranged so that, at the inclined position, the height from the stacking surface 201*a* becomes gradually higher from the upstream side to the downstream side in the ejection direction of the paper 40 (Y-direction of FIG. 10) so as to guide the ejected paper 40. On the other hand, the paper ejection tray assembly 22 is not provided with the pair of ribs 210*a*, 210*b* which the paper ejection tray assembly 20 shown in FIG. 1 to FIG. 8 is provided with. The shapes and functions of the slide tray part 202 and flap part 220 which the paper ejection tray assembly 22 is provided with are similar to the slide tray part 202 and flap part 220 of the paper ejection tray assembly 20, so explanations will be omitted.

The paper ejection tray assembly 22 is provided at the stacking surface 201*a* with the flap part 220 which moves to an inclined position. Due to this, the ejected paper 40 is lifted up by the flap part 220. The paper 40 which rides over the flap part 220 is raised up once in the air, then lands on the slide tray part 202. At this time, the contact area with the stacked paper is reduced by the area of the paper raised up in the air. Since the contact area is reduced, the frictional force between the stacked paper and the ejected paper is also reduced, so the stacked paper does not move due to paper ejection and push-off can be reduced.

Note that, in the paper ejection tray assembly 20 of the embodiment shown in FIG. 1 to FIG. 8, the paper 40 which is ejected from the ejection slot 11 passes between the pair of ribs 210*a*, 210*b* and is further raised up by the flap part 220. For this reason, compared with the case like in the paper ejection tray assembly 22 shown in FIG. 10 where only a flap part 220 is provided, the paper 40 is stacked in a curved manner. For this reason, the frictional area between the paper sheets is reduced, buckling of the ejected paper is prevented, and the ejected paper can be prevented from pushing off stacked paper.

According to the paper ejection tray assembly, when paper is ejected, the two side parts of the paper are supported by a pair of ribs, so the paper is bent in a recessed state in a direction perpendicular to the paper ejection direction and stiffened. Further, the pair of ribs respectively have first inclined surfaces which guide the paper, so the landing angle when the paper lands on the paper ejection tray assembly becomes smaller. For this reason, buckling of the paper becomes harder and in turn paper eject jams can be prevented.

What is claimed is:

1. A paper ejection tray assembly for ejecting paper in an ejection direction in an image reading device comprising:

a tray body having a side and a top and including a stacking surface on the top for stacking an ejected paper;

a pair of movable ribs arranged a predetermined distance apart from each other in a direction perpendicular to the ejection direction and projecting out from the stacking surface of the tray body when paper is ejected from an ejection slot;

a flap part arranged at a downstream side of the ejection direction with respect to the pair of movable ribs, on a top surface of the tray body; and a slide tray part provided at the tray body for being pulled out of the tray body at a particular location of the tray body and arranged at the downstream side of the ejection direction with respect to the flap part, when the slide tray part is pulled out from the tray body, wherein there is no overlap between the flap part and the particular location in the ejection direction in a view from the side of the tray body, wherein each of the pair of movable ribs includes a first inclined surface with a height from the stacking surface gradually becoming higher from the downstream side toward an upstream side of the ejection direction to guide the paper ejected from the ejection slot, and wherein the flap part is arranged so that a height of the flap part from the stacking surface becomes gradually higher from the upstream side to the downstream side of the ejection direction wherein a width of the flap part in the direction perpendicular to the ejection direction is larger than a distance between the pair of movable ribs in the direction perpendicular to the ejection direction.

2. The paper ejection tray assembly according to claim 1, wherein each of the pair of movable ribs includes a second inclined surface which gradually becomes higher in a height of projection from the stacking surface from the upstream side to the downstream side of the ejection direction and angles between respective first inclined surfaces and respective second inclined surfaces are formed as an obtuse angle.

3. The paper ejection tray assembly according to claim 1, wherein each of the pair of movable ribs includes a two side surfaces which are arranged inclined to a left and a right sides of respective first inclined surfaces.

4. The paper ejection tray assembly according to claim 1, wherein each of the pair of movable ribs is accommodated in the tray body.

5. The paper ejection tray assembly according to claim 4, wherein each of the pair of movable ribs is attached in a direction vertical with respect to the stacking surface of the tray body and capable of being pivoted about end parts which are positioned at the downstream side in the ejection direction.

6. The paper ejection tray assembly according to claim 4, wherein each of the pair of movable ribs is supported from the tray body by respective elastic members.

7. The paper ejection tray assembly according to claim 1, wherein the heights by which the pair of ribs project out from the stacking surface are at least 5 mm.

8. The paper ejection tray assembly according to claim 1, wherein an inclination of the first inclined surfaces with respect to the stacking surface is in the range of 10 degrees to 20 degrees.

9. The paper ejection tray assembly according to claim 1, wherein the flap part moves to an inclined position when the slide tray part is pulled out from the tray body, and the flap part is arranged so that, at the inclined position, the height from the stacking surface becomes gradually higher from the upstream side to the downstream side in the ejection direction to guide the ejected paper.

10. The paper ejection tray assembly according to claim 1, wherein the flap part is a plate-shaped member.

11. The paper ejection tray assembly according to claim 1, wherein the flap part rests on the tray body when the slide tray part is pulled in the tray body, and the flap part rises on the tray body when the slide tray part is pulled out from the tray body.

* * * * *